United States Patent [19]

Stoltzman

[11] Patent Number: 4,701,968

[45] Date of Patent: Oct. 27, 1987

[54] PORTABLE GOLF BALL WASHER

[76] Inventor: Gary L. Stoltzman, 6315 Upper 44th St., Oakdale, Minn. 55109

[21] Appl. No.: 904,696

[22] Filed: Sep. 8, 1986

[51] Int. Cl.[4] ..... A63B 47/04; A46B 11/02

[52] U.S. Cl. ..... 15/21 A; 273/32 B; 401/11

[58] Field of Search ..... 15/21 A, 97 R; 401/9, 401/11; 273/32 R, 32 B

[56] References Cited

U.S. PATENT DOCUMENTS 4,210,974 7/1980 Stoltzman ..... 15/21 A 4,464,072 8/1984 Norwell ..... 15/21 A

*Primary Examiner*—Edward L. Roberts

*Attorney, Agent, or Firm*—Jacobson and Johnson

[57] ABSTRACT

A portable hand-held golf ball washer comprises a housing having an elongated ball cleaning chamber with an elongated opening for inserting and holding the golf ball and an enclosed cleaning fluid chamber with a conventional manually operable pump and spray head for directing cleaning fluid into the ball cleaning chamber.

4 Claims, 4 Drawing Figures

PORTABLE GOLF BALL WASHER

FIELD OF THE INVENTION

This invention is directed toward golf ball washers and particularly toward a compact, portable, hand-carried ball washer having a ball cleaning chamber and a cleaning chamber and means for spraying cleaning fluid from the cleaning fluid chamber into the ball cleaning chamber and means for moving the ball against cleaning bristles in the cleaning chamber.

DESCRIPTION OF THE PRIOR ART

U.S. Pat. No. 4,210,974 dated July 8, 1980 granted to the same inventor as in the instant application, illustrates a similar type of portable golf ball washer. The patented washer requires a specially designed hand operable pump to apply cleaning fluid from the cleaning fluid chamber into the ball washer chamber which makes it somewhat costly to produce.

SUMMARY OF THE INVENTION

A housing has an elongated ball cleaning chamber with bristles extending into the chamber from the walls for rubbing against a golf ball inserted into the chamber. An elongated open slot through the front wall of the housing provides means for manually inserting the golf ball into the ball cleaning chamber and for holding it while rubbing it against the bristles for cleaning. The housing also has a separate enclosed chamber for cleaning fluid with an opening at the top of the cleaning fluid chamber in which a standard conventional hand operable plunger-type pump with spray head is inserted to manually pump cleaning fluid out of the cleaning chamber. An opening is provided in the rear wall of the ball cleaning chamber for allowing the cleaning fluid to be sprayed into the cleaning chamber and onto the ball. A guide arm attached to the spray head engages a guide slot formed in the rear wall of the cleaning chamber to direct the spray head toward the fluid receiving opening in the ball cleaning chamber. The device utilizes a conventional commercially available hand operable plunger with spray head used with various bottled liquid products such as glass cleaner, liquid soaps, etc. for pumping fluid out of a container and spraying it onto an object. In this fashion, then, the golf ball cleaner of the instant invention is significantly less costly to produce and therefore results in better marketability. Further, since a standard conventional plunger-type pump and spray head is utilized, in case the pump is damaged it can be easily and inexpensively replaced. All of this is achieved while still retaining the features and advantages of a hand-held portable golf ball washer such as the convenience of having it handily available, particularly around the greens, while the cleaning fluid is securely contained in a nonspillable, nonleakable chamber and the cleaning fluid is isolated from the ball cleaning chamber so that it does not get contaminated by dirt which is washed off the ball.

DESCRIPTION OF THE PREFERRED EMBODIMENT

Figure 2:
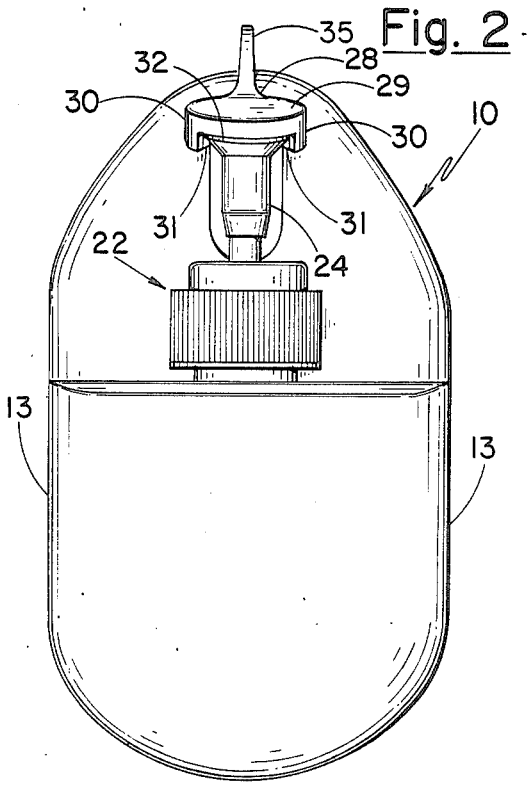
FIG. 2 is a view from what is considered to be the rear.
Figure 3:
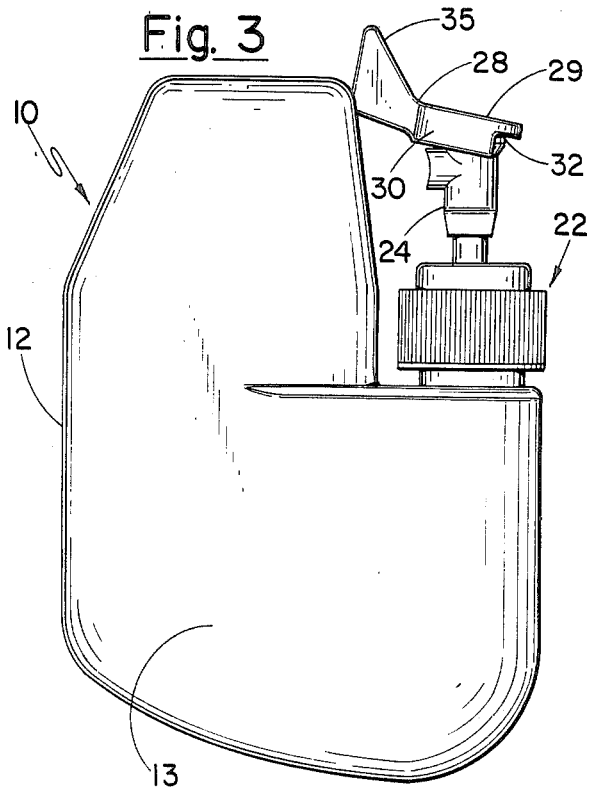
FIG. 3 is a side view.
Figure 1:
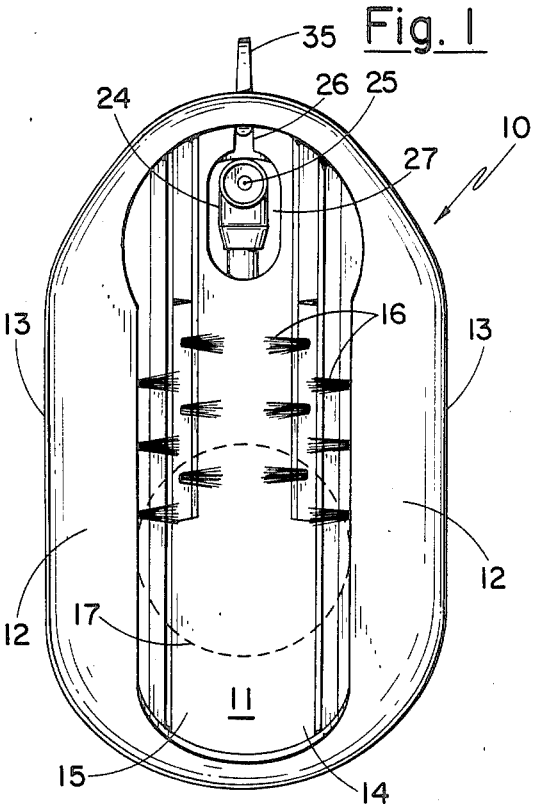
FIG. 1 is a view of the preferred embodiment of the invention from what is considered to be the front of the ball washer.
Figure 4:
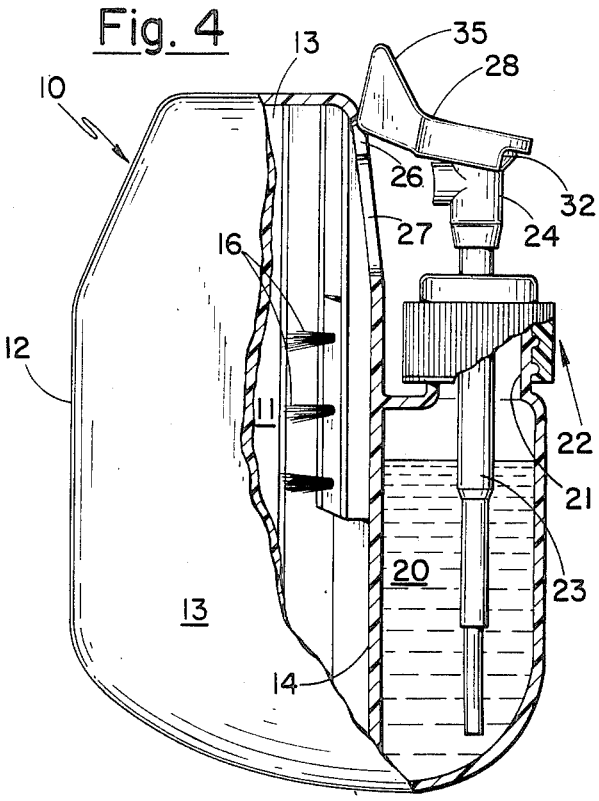
FIG. 4 is a partially sectioned side view.

A housing 10 preferably made out of plastic but which can be made out of any suitable durable material, contains an elongated generally cylindrical ball cleaning chamber 11 defined by front wall 12 sidewalls 13 and rear wall 14. An elongated opening 15 in front wall 12 is enlarged somewhat at its top end for insertion of a golf ball into the cleaning chamber 11 and allows the golf ball to be held with the fingers while moving it up and down in chamber 11 for cleaning. A golf ball 17 is shown in phantom in FIG. 1 for illustrative purposes. Sets of bristles 16 extend inward into the cleaning chamber 11 from the rear wall 14 and the sidewalls 13 for rubbing against the ball to clean it. The type and arrangement of the bristles are a matter of choice and the manner in which the bristles are attached to the walls does not constitute part of the instant invention. Preferably the bristles are attached in some fashion so that if they become worn, they can be removed and replaced so that the ball cleaner does not have to be discarded merely because the bristles have become worn.

Housing 10 also includes another enclosed chamber 20 for holding cleaning fluid. One wall of the cleaning chamber 20 is common with the lower half of the rear wall 14 of ball cleaning chamber 11. Covering a threaded opening 21 at the top of the fluid chamber 20 is a conventional cap assembly 22 for an elongated tubular plunger 23. At the top end of plunger 23 is a conventional spray head 24 having an orifice or nozzle 25. The combination of cap assembly 22 plunger 23 and spray head 24 is conventional and commercially available and while it is an essential part of the invention, its construction and function is not considered part of the instant invention. The assembly operates in a conventional fashion in that the plunger head is depressed downward into the fluid chamber 20 to draw fluid out of the fluid chamber 20 and spray it out of the spray nozzle 25. When not in use the sprayer, plunger cap assembly can be removed and replaced with a closed cap threaded over opening 21.

In the upper part of the rear wall 14 of cleaning chamber 11 is an elongated opening 27 which permits the cleaning fluid to enter the cleaning chamber 11 from the spray head 24 through spray nozzle 25 when plunger 23 is depressed. In order to ensure that the spray nozzle is aligned with the opening 27 a guide 28 is attached to the top of spray head 24 and extends into a guide slot 26 which is formed above the opening 27 in the rear wall 14 of cleaning chamber 11. Typically, guide means 28 has a disk-like section 29 which rests river the top of the spray head 24 and has downward extending L-shaped sidewalls 30 which define slots 31 for snugly but removably engaging flange 32 on the top of the spray head 24 so that guide member 28 will move up and down along with plunger 23 when it is depressed and released. Extending towards the rear wall 14 of the cleaning chamber 11 and engaged in slot 26 is an ear-shaped section 35 of guide member 28 which extends from the disk-like section 29. The engagement of ear 35 with slot 26 keeps the spray nozzle 25 aligned with opening 27 to ensure that the cleaning fluid is sprayed into the ball cleaning chamber 11 when the plunger is depressed. Slot 26 extends to the top edge of the rear wall 14 so that if cap assembly 22 is unthreaded from opening 21, plunger 23 can move upwardly and be removed from the cleaning chamber 20 in order to refill the chamber with additional cleaning fluid or, if the plunger is damaged, it can then be replaced without discarding the entire ball washer.

I claim:

1. In a portable hand-held golf ball washer having a partially walled-in ball cleaning chamber and an enclosed chamber for containing cleaning fluid, the improvement comprising:

a vertically movable hand-operable plunger for pumping fluid out of the cleaning fluid chamber, said plunger extending upward from the cleaning fluid chamber outside the wall of the ball cleaning chamber and having a spray orifice at its upper end;

an opening through the wall of the ball cleaning chamber; and means for directing said spray orifice toward said opening to spray cleaning fluid into said ball cleaning chamber.

2. The invention as described in claim 1 wherein said means for directing the orifice toward the opening in the ball cleaning chamber comprises:

a guide slot in the wall of the ball cleaning chamber; and guide means attached to said plunger for slidably engaging said guide slot.

3. A portable manually operable golf ball washer, comprising:

(a) a housing;

(b) an elongated ball cleaning chamber in said housing having front, rear and side walls, said chamber having an elongated opening in its front wall for manually inserting and moving a golf ball in the chamber for cleaning;

(c) an enclosed cleaning fluid chamber in said housing outside said ball cleaning chamber, one wall of said cleaning fluid chamber being common with the lower portion of the rear wall of said ball cleaning chamber;

(d) a vertically movable manually operable plunger for pumping fluid out of said cleaning fluid chamber, said plunger extending upward from the cleaning fluid chamber outside the ball cleaning chamber and having a spray orifice at its upper end;

(e) the upper portion of the rear wall of the ball cleaning chamber having an opening for receiving cleaning fluid; and (f) means for directing the plunger spray orifice toward said cleaning fluid receiving opening to spray cleaning fluid into the ball cleaning chamber.

4. The invention as described in claim 3 wherein said means for directing the spray orifice toward said cleaning fluid receiving opening, comprises:

a guide slot in the outside of the rear wall of said ball cleaning chamber; and guide means attached to said plunger for slidably engaging said guide slot.

* * * * *